US006372002B1

(12) United States Patent
D'Evelyn et al.

(10) Patent No.: US 6,372,002 B1
(45) Date of Patent: Apr. 16, 2002

(54) FUNCTIONALIZED DIAMOND, METHODS FOR PRODUCING SAME, ABRASIVE COMPOSITES AND ABRASIVE TOOLS COMPRISING FUNCTIONALIZED DIAMONDS

(75) Inventors: Mark Philip D'Evelyn, Niskayuna, NY (US); James Michael McHale, Jr., Worthington, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/576,794

(22) Filed: May 23, 2000

Related U.S. Application Data

(60) Provisional application No. 60/188,874, filed on Mar. 13, 2000.

(51) Int. Cl.[7] ..... B24D 3/00; B24D 17/00

(52) U.S. Cl. ..... 51/307; 51/309; 51/295; 51/293; 51/298

(58) Field of Search ..... 51/309, 307, 295, 51/293, 298

(56) References Cited

U.S. PATENT DOCUMENTS 5,593,783 A 1/1997 Miller

OTHER PUBLICATIONS

Elsevier, Diamond and Related Materials, "Halogenation and Butylation of Diamond Surfaces By Reactions in Organic Solvents", Yoshinori Ikeda, Takeyasu Saito, Katuski Kusakabe, Shigeharu Morooka, Hideaki Maeda, Yuki Taniguchi and Yuzo Fujiwara, vol. 7, pp. 830–834, 1998. (No month).

Elsevier, Diamond and Related Materials, "Properties of Photochemically Modified Diamond Films", John B. Miller and Duncan W. Brown, vol. 4, pp. 435–440, 1995. (No month).

Elsevier, Journal of the European Ceramic Society, "Growth, Preparation and Surface Modification of Microcrystalline Diamond Powder for the Synthesis of Diamond Ceramics", O. Semchinova, D. Uffmann, H. Neff and EP Smirnov, vol. 16, pp. 753–758, 1996. (No month).

J. Am. Chem. Soc., Reaction Between Oligomers and the Surface of Diamond Powder Containing Functional Groups, MT Bryk, NN Baglei, EP Smirnov, SK Gordeev, AF Burban and VB Aleskovskii, pp. 782–785, 1984. (No month).

Sov. J. Superhard Material, "Oleophilic Character of Modified Synthetic Diamonds and Elbor", AE Shilo, VA Sviderskii and EA Pashchenko, vol. 8, No. 22, pp. 27–31, 1986 (No month).

Sov. J. Superhard Material, "Tools, Powders and Pastes", FB Danilova, AE Gorbunova, MT Bryk, AF Burban, SK Gordeev and VA Manzhar, vol. 11, No. 5, pp. 41–45, 1989 (No month).

Carbon, Pergamon Press, Printed in Great Britain, "Chemie Der Oberflache Des Diamanten—I. Benetzungswarmen, Elektronenspinresonanz Und Infrarotspektren Der Oberflachen–Hydride,–Halogenide Und–Oxide", R. Sappok and HP Boehm, vol. 6, pp. 283–295, 1968. (No month).

Vliyanie Khim. Fiz.–Khim. Vozdeistv. Svoistva Almazov, "Modification of the Surfaces of Ultrafine Diamonds", VI. Makal'skii, VF Loktev, IV Stoyanova, AS Kalinkin, GS Litvak, EM Moroz, and VA Likholobov, pp. 48–54, 1990 (No month).

J. Chem. Soc. Faraday Trans., "Vapour–Phase Oxidation of Diamond Surfaces in $O_2$ Studied By Diffuse reflectance Fourier–Transform Infrared and Temperature–Programmed Desorption Spectroscopy", Toshihiro Ando, Kazuo Yamamoto, Motohiko Ishii, Mutsukazu Kamo and Yolchiro Sata, vol. 89 (19), pp. 3635–3640, 1993. (No month).

J. Vac. Sci. Technol. A, "Interaction of Hydrogen and Water With Diamond (100): Infrared Spectroscopy", Lisa M. Struck and Mark P. D'Evelyn, vol. 11 (4), pp. 1992–1997, Jul./Aug. 1993.

Zhurnal Prikladnoi Khimii, "Synthesis of Halide Functional Groups on the Surface of Diamond", EP Smirnov, SK Gordeev, SI Kol'tsov and VB Aleskovskii, vol. 51, No. 11, pp. 2451–2455, 1978. (No month.

Doklady Akademii Nauk SSSR, "Mutual Influence of Functional Groups in Substitution Reactions On Diamond Surface", CK Gordeev, EP Smirnov and VB Aleskovskii, vol. 261, No. 1, pp. 6–8, 1982. (No month).

Journal of the Chinese Chemical Society, "Interaction of Chlorine With Hydrogenated Diamond Surface", Toshihiro Ando, Kazuo Yamamoto, Shigeru Suehara, Mutsukazu Kamo, Yoichiro Sato, Shinji Shimosaki and Mikka Nishitani–Gamo, vol. 42, pp. 285–292, 1995. (No month).

Elsevier, Diamond and Related Materials, "Chemical Modification of Diamond Surfaces Using a Chlorinated Surface as an Intermediate State", Toshihiro Ando, Mikka Nishitani–gamo, Robin E. Rawles, Kazuo Yamamoto, Mutsukazu Kamo and Yoichiro Sato, vol. 5, pp. 1136–1142, 1996. (No month).

J. Chem. Soc. Faraday Trans., "Thermal Hydrogenation of Diamond Surfaces Studied By Diffuse reflectance Fourier–Transform Infrared, Temperature–Programmed Desorption and Laser Raman Spectroscopy", Toshihiro Ando, Motohiko Ishii, Mutsukazu Kamo and Yoichiro Sato, vol. 89 (11), pp. 1783–1789, 1993. (No month).

J. Am. Chem. Soc., "Functionalization of Diamond (100) by Diels–Alder Chemistry", GT Wang, SF Bent, JN Russell, Jr., JE Butler and MP D'Evelyn, vol. 122, pp. 744–745, 2000. (No month).

*Primary Examiner*—Michael Marcheschi
(74) *Attorney, Agent, or Firm*—Ben P. Patel; Noreen C. Johnson

(57) ABSTRACT

A functionalized diamond comprises an organic functionalized moiety. The organic functionalized moiety being selected from: vinyl, amide, alcohol, acidics, phenolics, hydroxyls, carboxyl, aldehyde, and aliphatics, and combinations thereof.

11 Claims, 2 Drawing Sheets

FUNCTIONALIZED DIAMOND, METHODS FOR PRODUCING SAME, ABRASIVE COMPOSITES AND ABRASIVE TOOLS COMPRISING FUNCTIONALIZED DIAMONDS

This application claims the priority of U.S. Provisional Application No. 60/188,874, filed Mar. 13, 2000, by inventors D'Evelyn and McHale.

BACKGROUND OF THE INVENTION

The invention relates to functionalized diamonds. In particular, the invention relates to functionalized diamonds with enhanced retention in resins.

Diamonds, for example mesh crystals and micron powders, can be used as abrasive materials in many applications. For example, diamonds are used in abrasive tools, machinery, cutting implements, grinding tools, and other types of abrasive similar equipment. The desirability of diamonds in abrasive applications is due, at least in part to, their hardness. While diamonds, which are known as the hardest natural material, possess useful abrasive characteristics, their applications in various equipment and environments may be limited. For example, diamond applications may be limited by the retention of the diamonds to the equipment. Often, the performance and life of the equipment is limited by retention of the diamond.

The diamond is typically provided in a matrix for abrasive purposes, in which the matrix may comprise a resin. The abrasive equipment typically includes a substrate that is provided with the diamond-ladened matrix. The bond strength between the particles and matrix is the determinative strength for the abrasive equipment. Enhanced bond strength between diamonds and an associated matrix should increase the retention therebetween. Accordingly, performance and life of abrasive equipment tool provided with the diamond-ladened matrix should increase.

It has been proposed to alter surfaces of diamonds to enhance the bond strength between the diamonds and associated matrix. For example, it has been proposed to functionalize diamond surfaces to enhance bond strength between the diamonds and matrix. This funcionalization attempted to modify wettability of the diamond with respect to various polymeric resin precursors. The modification attempted to increase a physical interaction bond strength between diamonds and an associated matrix. However, the physical interaction forces between a diamond and an associated matrix are weaker than those formed by chemical bonds. Further, functionalizing diamonds with moieties that are capable of forming strong covalent bonds with an associated resin are not known to have been explored for abrasive applications.

Therefore, a need exists for abrasive composites, functionalized diamonds, and resin-bond matrices for use in abrasive applications. Further, a need exists for a method of providing these functionalized diamonds and resin-bond matrices with enhanced strength bonds.

SUMMARY OF THE INVENTION

An aspect of the invention provides a functionalized diamond comprising an organic functionalized moiety. The organic functionalized moiety selected from vinyl, amide, alcohol, acidics, phenolics, hydroxyls, and aliphatics, and combinations thereof.

A further aspect of the invention provides a diamond functionalized by an organic moiety, the diamond functionalized by an organic moiety by a reaction, where x is an integer between 0 and about 20;

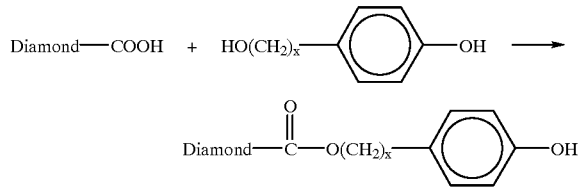

Yet another aspect of the invention provides a diamond functionalized by an organic moiety, the diamond functionalized by an organic moiety by a reaction selected from any one of, where x is an integer between 0 and about 20;

Diamond-COOH+HO$(CH_2)_x$CH=$CH_2$→Diamond-COO$(CH_2)_x$CH=$CH_2$;

Diamond-COOH+HO$CH_2(CH_2)_x$OH→Diamond-COO$CH_2(CH_2)_x$OH;

Diamond-COOH+HO$(CH_2)_x$$CONH_2$→Diamond-COO$(CH_2)_x$$CONH_2$;

Diamond-COOH+HO$(CH_2)_x$COH→Diamond-COO$(CH_2)_x$COH;

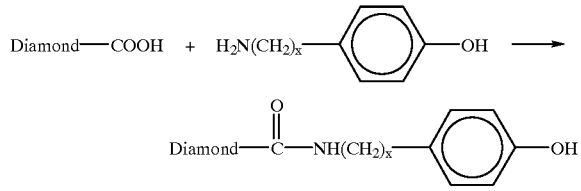

Diamond-COOH+$H_2N(CH_2)_x$CH=$CH_2$→Diamond-CONH$(CH_2)_x$CH=$CH_2$;

Diamond-COOH+$H_2NCH_2(CH_2)_x$OH→Diamond-CONH$CH_2(CH_2)_x$OH;

Diamond-COOH+$H_2N(CH_2)_x$$CONH_2$→Diamond-CONH$(CH_2)_x$$CONH_2$; and

Diamond-COOH+$H_2N(CH_2)_x$COH→Diamond-CONH$(CH_2)_x$COH;

Diamond-Cl+$C_3H_6$→Diamond-$CH_2$CH=$CH_2$+HCl; and

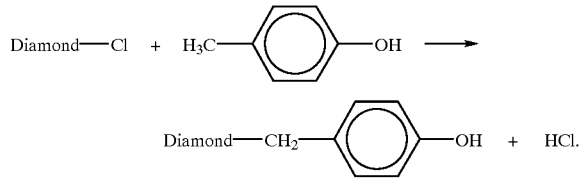

Another aspect of the invention sets forth a diamond functionalized by an organic moiety, the diamond functionalized by an organic moiety by a reaction, where x is an integer between 0 and about 20, selected from any one of:

Diamond-Cl+HO$(CH_2)_x$CH=$CH_2$→Diamond-O$(CH_2)_x$CH=$CH_2$+HCl;

Diamond-Cl+HO$CH_2(CH_2)_x$OH→Diamond-O$CH_2(CH_2)_x$OH+HCl;

Diamond-Cl+HO$(CH_2)_x$$CONH_2$→Diamond-O$(CH_2)_x$$CONH_2$+HCl;

Diamond-Cl+HO$(CH_2)_x$COH→Diamond-O$(CH_2)_x$COH+HCl;

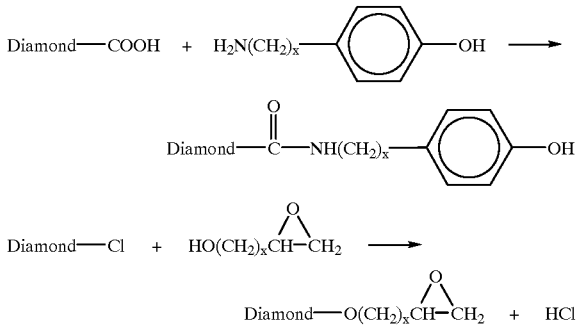

Diamond-Cl+$H_2N(CH_2)_xCH{=}CH_2$→Diamond-$NH(CH_2)_xCH{=}CH_2$+HCl;

Diamond-Cl+$H_2NCH_2(CH_2)_xOH$→Diamond-$NHCH_2(CH_2)_xOH$+HCl;

Diamond-Cl+$H_2N(CH_2)_xCONH_2$→Diamond-$NH(CH_2)_xCONH_2$+HCl;

Diamond-Cl+$H_2N(CH_2)_xCOH$→Diamond-$NH(CH_2)_xCOH$+HCl;

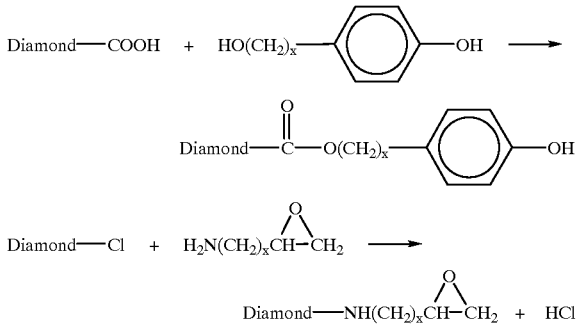

A further aspect of the invention provides an abrasive composite that includes a diamond functionalized by an organic moiety, the diamond functionalized by an organic moiety by a reaction, where x is an integer between 0 and about 20:

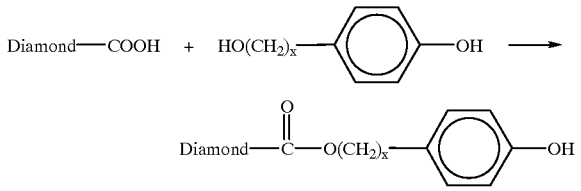

Yet another aspect of the invention provides an abrasive composite that includes a diamond functionalized by an organic moiety, the diamond functionalized by an organic moiety by a reaction, where x is an integer between 0 and about 20, selected from any one of:

Diamond-COOH+$HO(CH_2)_xCH{=}CH_2$→Diamond-$COO(CH_2)_xCH{=}CH_2$;

Diamond-COOH+$HOCH_2(CH_2)_xOH$→Diamond-$COOCH_2(CH_2)_xOH$;

Diamond-COOH+$HO(CH_2)_xCONH_2$→Diamond-$COO(CH_2)_xCONH_2$;

Diamond-COOH+$HO(CH_2)_xCOH$→Diamond-$COO(CH_2)_xCOH$;

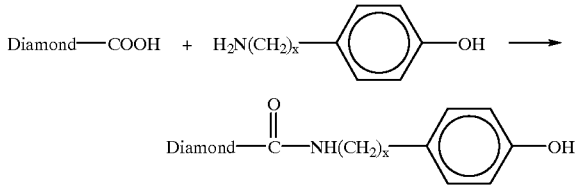

Diamond-COOH+$H_2N(CH_2)_xCH{=}CH_2$→Diamond-$CONH(CH_2)_xCH{=}CH_2$;

Diamond-COOH+$H_2NCH_2(CH_2)_xOH$→Diamond-$CONHCH_2(CH_2)_xOH$;

Diamond-COOH+$H_2N(CH_2)_xCONH_2$→Diamond-$CONH(CH_2)_xCONH_2$; and

Diamond-COOH+$H_2N(CH_2)_xCOH$→Diamond-$CONH(CH_2)_xCOH$;

Diamond-Cl+$C_3H_6$→Diamond-$CH_2CH{=}CH_2$+HCl; and

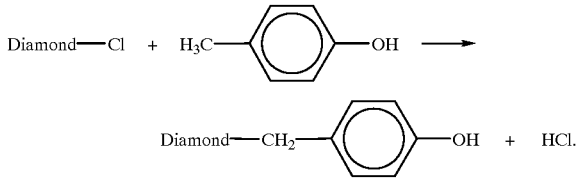

Another aspect of the invention sets forth an abrasive composite that includes a diamond functionalized by an organic moiety, the diamond functionalized by an organic moiety by a reaction, where x is an integer between 0 and about 20, selected from any one of:

Diamond-Cl+$HO(CH_2)_xCH{=}CH_2$→Diamond-$O(CH_2)_xCH{=}CH_2$+HCl;

Diamond-Cl+$HOCH_2(CH_2)_xOH$→Diamond-$OCH_2(CH_2)_xOH$+HCl;

Diamond-Cl+$HO(CH_2)_xCONH_2$→Diamond-$O(CH_2)_xCONH_2$+HCl;

Diamond-Cl+$HO(CH_2)_xCOH$→Diamond-$O(CH_2)_xCOH$+HCl;

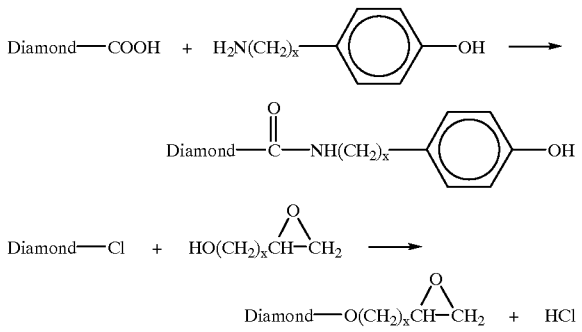

Diamond-Cl+$H_2N(CH_2)_xCH{=}CH_2$→Diamond-$NH(CH_2)_xCH{=}CH_2$+HCl;

Diamond-Cl+$H_2NCH_2(CH_2)_xOH$→Diamond-$NHCH_2(CH_2)_xOH$+HCl;

Diamond-Cl+$H_2N(CH_2)_xCONH_2$→Diamond-$NH(CH_2)_xCONH_2$+HCl;

Diamond-Cl+$H_2N(CH_2)_xCOH$→Diamond-$NH(CH_2)_xCOH$+HCl;

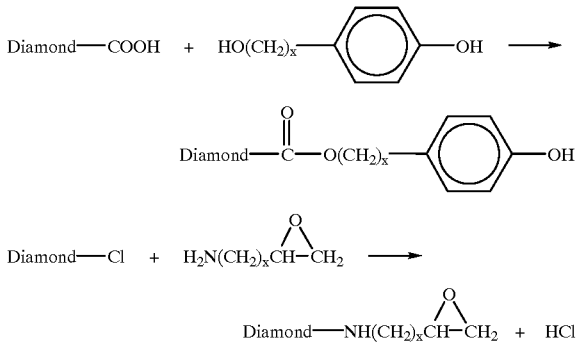

A further aspect of the invention provides an abrasive tool that includes a diamond functionalized by an organic moiety, the diamond functionalized by an organic moiety by a reaction, where x is an integer between 0 and about 20:

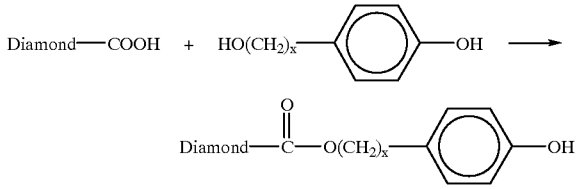

Yet another aspect of the invention provides an abrasive tool that includes a diamond functionalized by an organic moiety, the diamond functionalized by an organic moiety by a reaction, where x is an integer between 0 and about 20, selected from any one of:

Diamond-COOH+$HO(CH_2)_xCH{=}CH_2$→Diamond-COO$(CH_2)_xCH{=}CH_2$;

Diamond-COOH+$HOCH_2(CH_2)_xOH$→Diamond-$COOCH_2(CH_2)_xOH$;

Diamond-COOH+$HO(CH_2)_xCONH_2$→Diamond-COO$(CH_2)_xCONH_2$;

Diamond-COOH+$HO(CH_2)_xCOH$→Diamond-$COO(CH_2)_xCOH$;

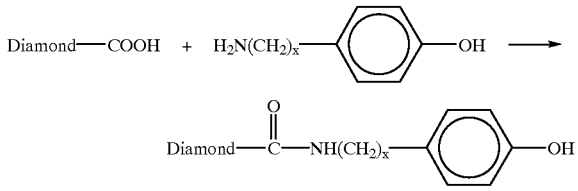

Diamond-COOH+$H_2N(CH_2)_xCH{=}CH_2$→Diamond-$CONH(CH_2)_xCH{=}CH_2$;

Diamond-COOH+$H_2NCH_2(CH_2)_xOH$→Diamond-$CONHCH_2(CH_2)_xOH$;

Diamond-COOH+$H_2N(CH_2)_xCONH_2$→Diamond-CONH$(CH_2)_xCONH_2$; and

Diamond-COOH+$H_2N(CH_2)_xCOH$→Diamond-CONH$(CH_2)_xCOH$;

Diamond-Cl+$C_3H_6$→Diamond-$CH_2CH{=}CH_2$+HCl; and

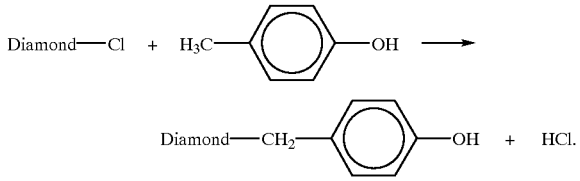

Another aspect of the invention sets forth an abrasive tool that includes a diamond functionalized by an organic moiety, the diamond functionalized by an organic moiety by a reaction, where x is an integer between 0 and about 20, selected from any one of:

Diamond-Cl+$HO(CH_2)_xCH{=}CH_2$→Diamond-$O(CH_2)_xCH{=}CH_2$+HCl;

Diamond-Cl+$HOCH_2(CH_2)_xOH$→Diamond-$OCH_2(CH_2)_xOH$+HCl;

Diamond-Cl+$HO(CH_2)_xCONH_2$→Diamond-$O(CH_2)_xCONH_2$+HCl;

Diamond-Cl+$HO(CH_2)_xCOH$→Diamond-$O(CH_2)_xCOH$+HCl;

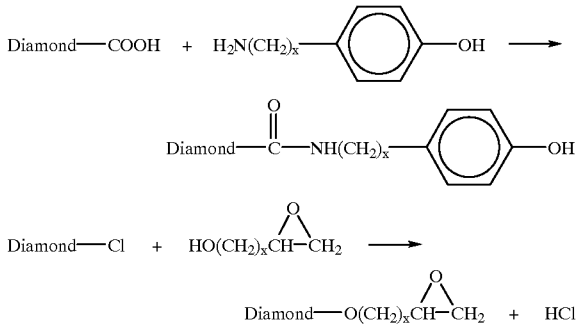

Diamond-Cl+$H_2N(CH_2)_xCH{=}CH_2$→Diamond-$NH(CH_2)_xCH{=}CH_2$+HCl;

Diamond-Cl+$H_2NCH_2(CH_2)_xOH$→Diamond-$NHCH_2(CH_2)_xOH$+HCl;

Diamond-Cl+$H_2N(CH_2)_xCONH_2$→Diamond-$NH(CH_2)_xCONH_2$+HCl;

Diamond-Cl+$H_2N(CH_2)_xCOH$→Diamond-$NH(CH_2)_xCOH$+HCl;

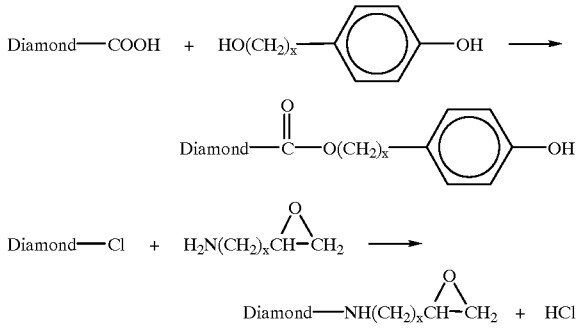

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
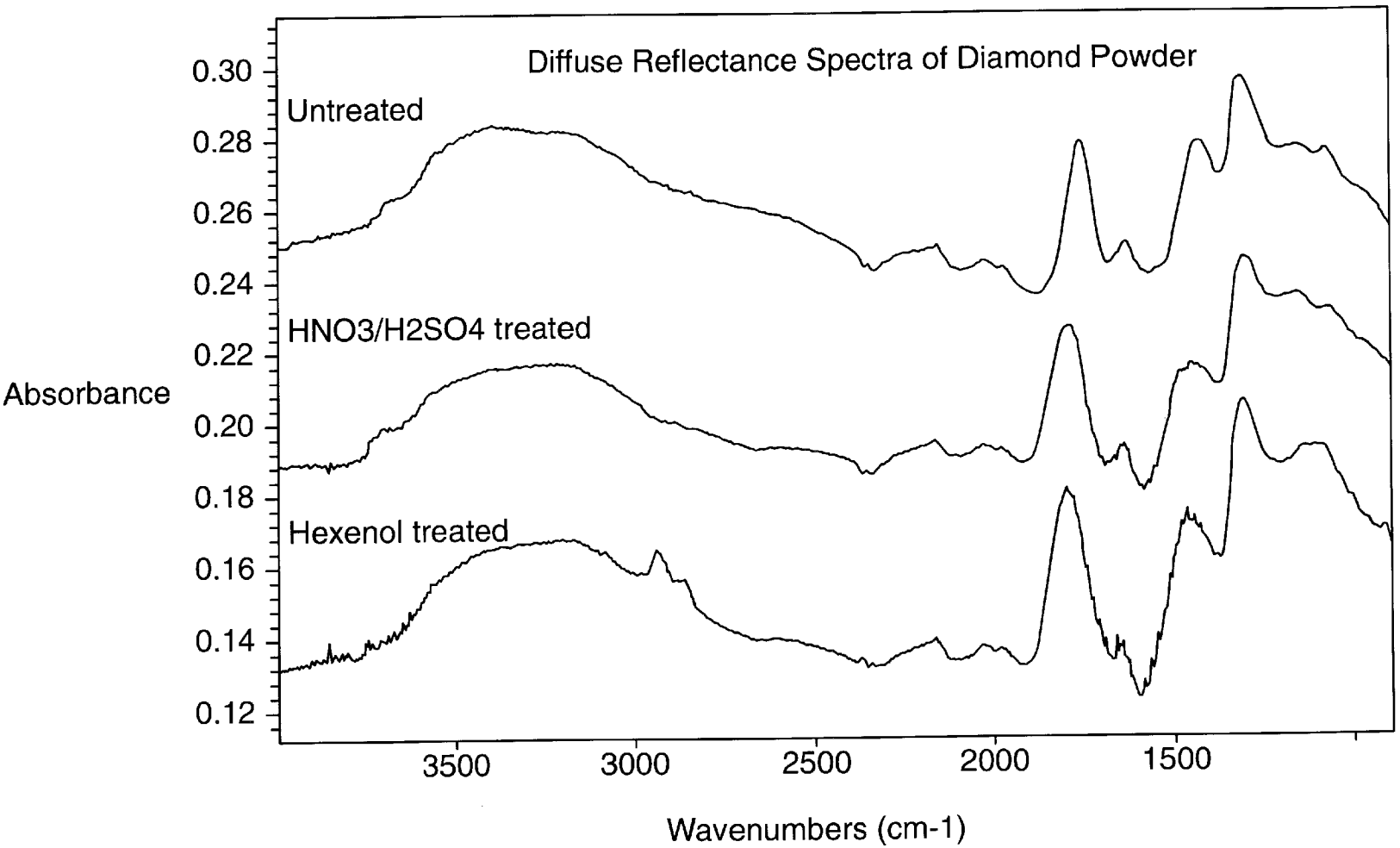
FIG. 1 is a set of spectra obtained by diffuse reflectance infrared Fourier-transform spectroscopy (DRIFTS) on functionalized diamonds, as embodied by the invention, in a potassium bromide (KBr) matrix.

Functionalized diamonds, as embodied by the invention, comprise diamonds whose surfaces are functionalized with organic groups (also referred to herein as "organic functionalizing moiety" or "organic moiety") to enhance the chemical bond strength with resin-bond matrices. These organic groups can co-polymerize with a resin-bond matrix. Thus, the functionalizing, as embodied by the invention, provides a diamond surface with an enhanced bond strength, for example formed by covalent bonds, in a resin-bond matrix. For example, the covalent bonds can comprise, but are not limited to, at least one of C—C; C—O; C—N; C—Si: Si—O; and Si—N bonds.

Further, the invention sets forth an abrasive composite and an abrasive tool with enhanced adhesion between diamonds with functionalized surfaces (hereinafter also referred to as "functionalized diamonds") and a resin-bond matrix. Thus, the abrasive composite, as embodied by the invention, comprises the functionalized diamonds, as embodied by the invention, and a resin-bond matrix. Also, the abrasive tool, as embodied by the invention, comprises functionalized diamonds and a resin-bond matrix for abrasive applications.

The term "resin-bond matrix" as used herein comprises a matrix of a resinous material to which at least one functionalized diamond can be included with enhanced diamond retention therein. Further, the term "diamond" includes, but is not limited to, naturally occurring diamonds and synthetic diamonds. Also, the term "diamond" comprise at least one of diamond crystals, diamond particles, and diamond micron powder particles.

The bonds, as discussed above, formed between the functionalized diamonds and the resin-bond matrices in an abrasive composite typically comprise covalent bonds. The covalent bonds can be produced by co-polymerization processes, as discussed hereinafter. The functionalized diamonds for use in abrasive applications, for example, but not limited to abrasive composites, comprise diamonds whose surfaces are functionalized by being covered with molecules that are disposed thereon. The molecules are capable of co-polymerization with resin bonds in a matrix.

The functionalized diamonds, as embodied by the invention, can comprise phenolic groups. The phenolic groups are bound to a diamond's surface by bonds, such as those described above. These phenolic groups can co-polymerize with phenolic-formaldehyde resins.

Alternatively, the functionalized diamonds, as embodied by the invention, can comprise vinyl groups. The vinyl groups can be bound to a diamond surface by bonds, such as those described above. These vinyl groups can undergo condensation with vinylic resins during the co-polymerization.

Another functionalized diamonds alternative, within the scope of the invention, comprises alcohol or hydroxyl groups on surfaces of diamonds. The alcohol groups are bound to a diamond surface by bonds, such as those described above, and can undergo polymerization with linear and branched polyacids and polyalcohols to form polyester resins.

A further functionalized diamonds alternative can comprise amide groups that are bound to a diamond surface by bonds, such as those described above. The amide groups can undergo polymerization with formaldehyde and at least one of urea and a polyamide.

A further functionalized diamonds alternative, as embodied by the invention, can comprise aldehyde groups on surfaces of the diamonds. These aldehyde groups can co-polymerize with phenolic resins.

A further functionalized diamonds alternative, within the scope of the invention, comprises epoxide groups on surfaces of the diamonds. These epoxide groups can co-polymerize with epoxy and polyether resins.

These functional groups are bound to a diamond surface by variable-length hydrocarbon chains, because of a high degree of steric hindrance that typically occurs near diamond surfaces. This steric hindrance may undesirably decrease the number of bonds than can be formed with resin-bond matrix molecules.

A functionalized diamond, as embodied by the invention, thus comprises an organic moiety that is covalently bonded to the diamond surface by bonds, such as those described above. The organic functionalized moiety selected from: vinyl, amide, alcohol, phenolic, hydroxyl, aldehyde, and epoxide groups, and combinations thereof.

The preparation of the functionalized diamonds, as embodied by the invention, can be conducted by several processes. An exemplary functionalized diamond preparation process, as embodied by the invention, comprises providing functionalized diamond particles with a near-monolayer concentration of carboxyl groups (—COOH) on its surface, or a concentration of in a range from about $0.1\times10^{15}$ $cm^{-2}$ to about $3\times10^{15}$ $cm^{-2}$. These functionalized diamonds can be prepared by boiling diamonds in a strongly oxidizing acid (in which the term "strongly is characteristic of acids as set forth in the example below). For example and in no way limiting of the invention, the oxidizing acid can comprise at least one of concentrated $HClO_4$ or 1% to 20% nitric acid ($HNO_3$) in concentrated sulfuric acid ($H_2SO_4$). This process can produce functionalized diamond particles that are hydrophilic.

The functionalized diamond particles may comprise a nearly full-monolayer of acidic groups on the diamond, that is, with a surface concentration in a range from about $0.1\times10^{15}$ $cm^{-2}$ to about $3\times10^{15}$ $cm^{-2}$. These functionalized diamond characteristics can be determined by appropriate analytic methods, such as at least one of infrared spectroscopy and basic titration.

The above process next forms covalent (chemical) bonds between the acidic diamond surface and a co-polymerizable molecule, also known as a functionalizing moiety. These covalent bonds can be formed by acid-catalyzed esterification or base-catalyzed amidization. Equations (1) through (5) set forth nomenclature for exemplary reactions that form covalent bonds, as embodied by the invention.

(1)

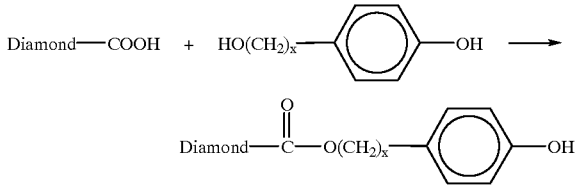

$$\text{Diamond-COOH}+\text{HO(CH}_2)_x\text{CH=CH}_2\rightarrow\text{Diamond-COO(CH}_2)_x\text{CH=CH}_2 \quad (2)$$

$$\text{Diamond-COOH}+\text{HOCH}_2\text{(CH}_2)_x\text{OH}\rightarrow\text{Diamond-COOCH}_2\text{(CH}_2)_x\text{OH} \quad (3)$$

$$\text{Diamond-COOH}+\text{HO(CH}_2)_x\text{CONH}_2\rightarrow\text{Diamond-COO(CH}_2)_x\text{CONH}_2 \quad (4)$$

$$\text{Diamond-COOH}+\text{HO(CH}_2)_x\text{COH}\rightarrow\text{Diamond-COO(CH}_2)_x\text{COH} \quad (5)$$

Alternatively, the covalent bonds can be produced by other reactions. Equations (6) through (10) set forth the nomenclature for further exemplary reactions that form covalent bonds, as embodied by the invention (6)

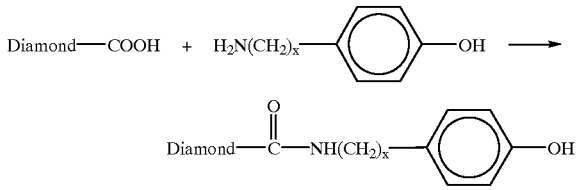

$$\text{Diamond-COOH}+\text{H}_2\text{N(CH}_2)_x\text{CH=CH}_2\rightarrow\text{Diamond-CONH(CH}_2)_x\text{CH=CH}_2 \quad (7)$$

$$\text{Diamond-COOH}+\text{H}_2\text{NCH}_2\text{(CH}_2)_x\text{OH}\rightarrow\text{Diamond-CONHCH}_2\text{(CH}_2)_x\text{OH} \quad (8)$$

$$\text{Diamond-COOH}+\text{H}_2\text{N(CH}_2)_x\text{CONH}_2\rightarrow\text{Diamond-CONH(CH}_2)_x\text{CONH}_2 \quad (9)$$

$$\text{Diamond-COOH}+\text{H}_2\text{N(CH}_2)_x\text{COH}\rightarrow\text{Diamond-CONH(CH}_2)_x\text{COH} \quad (10)$$

In each of the reactions in Equations (1–10), x is an integer between 0 and about 20. This value for x should allow for variable distances between the diamond surface and polymerizable functional group, for example, a polymerizable functional group selected from phenolic, vinyl, hydroxyl, amide, or aldehyde groups. The reactions set forth in Equations (1–10) provide enhanced bond strength in resin-bond matrices.

The invention also provides for functionalized diamonds with enhanced stability in aqueous acid or base environments. Some conventional chemical environments may cause the covalent bonds, for example, but not limited to, covalent bonds in the form of ester and amide linkages, to be unstable. These chemical environments are encountered in diamond processing steps, such as, but not limited to, heating of the functionalized diamonds in aqueous acid or base environments. For functionalized diamonds with enhanced stability in aqueous acid or base environments, the functional groups are attached to diamond surfaces by carbon-carbon, either-type carbon-oxygen, or secondary amine-type carbon-nitrogen bond linkages. These functional groups can be synthesized by the following exemplary process.

Alternatively, the chlorination step can be performed by photochemical reaction, exposing the diamond powder to ultraviolet radiation in a chlorine-containing environment. For example, and in no way limiting the invention, the ultraviolet radiation may be provided by a high-pressure mercury arc lamp.

Initially, diamond surfaces are hydrogenated. The hydrogenating step can comprise heating to the diamonds to a temperature in a range from about 700° C. to about 1200° C. in a hydrogen-containing environment. The hydrogenated diamond surfaces can then be chlorinated. The step of chlorinating can comprise heating the hydrogenated diamond to a temperature in a range from about 100° C. to about 500° C. in a $Cl_2$-containing environment.

The hydrogenating and chlorinating reactions are indicated schematically in Equations (11) and (12), respectively.

$$\text{Diamond-(mixed oxides)}+\text{H}_2\rightarrow\text{Diamond-H}+\text{H}_2\text{O}+\text{CO}+\text{CO}_2 \quad (11)$$

$$\text{Diamond-H}+\text{Cl}_2\rightarrow\text{Diamond-Cl}+\text{HCl} \quad (12)$$

The chlorinated diamond may react with hydrogen-containing molecules to produce molecules that are bound to diamond and HCl, particularly if the hydrogen atom(s) are more reactive than those in aliphatic hydrocarbons. Exposure of chlorinated diamond to water vapor at room temperature can produce OH groups that are bound to the diamond surface.

Surface vinyl groups can produced functionalized diamonds. The vinyl groups for functionalized diamonds can be produced by reacting chlorinated diamond with propylene at a temperature in a range between about 100° C. and about 600° C. Allylic C—H bonds are more reactive than normal aliphatic C—H bonds, and therefore a reaction as in Equation (13) can occur:

$$\text{Diamond-Cl}+\text{C}_3\text{H}_6\rightarrow\text{Diamond-CH}_2\text{CH=CH}_2+\text{HCl} \quad (13)$$

Alternatively, reaction of the chlorinated diamond with propylene can be performed by photochemical reaction, exposing the diamond powder to ultraviolet radiation in a propylene-containing environment.

Similarly, surface phenolic groups can be produced on diamonds for forming functionalized diamonds, as embodied by the invention. The surface phenolic groups on functionalized diamonds can be produced by reacting chlorinated diamond with p-cresol at a temperature in a range between about 100° C. and about 600° C. This reaction occurs as methyl C—H bonds in toluene are generally weaker than aromatic C—H bonds, and thus a reaction as set forth in Equation (14) can occur:

(14)

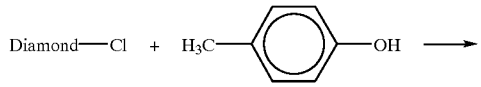

-continued

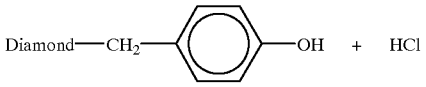

Alternatively, reaction of the chlorinated diamond with cresol can be performed by photochemical reaction, exposing the diamond powder to ultraviolet radiation in a cresol-containing environment.

Chlorinated diamond reacts more readily with O—H and N—H bonds than it does with C—H bonds, and the vinyl, phenolic, alcohol, amide, aldehyde, and epoxide moieties of the present invention can be formed by reactions with appropriate alcohols or amines.

Vinyl, alcohol, amide, aldehyde, phenolic, and epoxide groups can be formed on the diamond surface by reacting chlorinated diamond with polyfunctional alcohols at a temperature between about 0° C. and about 600° C., as indicated in Equations (15) through (20), respectively:

$$\text{Diamond-Cl}+\text{HO}(\text{CH}_2)_x\text{CH}{=}\text{CH}_2\rightarrow\text{Diamond-O}(\text{CH}_2)_x\text{CH}{=}\text{CH}_2+\text{HCl} \quad (15)$$

$$\text{Diamond-Cl}+\text{HOCH}_2(\text{CH}_2)_x\text{OH}\rightarrow\text{Diamond-OCH}_2(\text{CH}_2)_x\text{OH}+\text{HCl} \quad (16)$$

$$\text{Diamond-Cl}+\text{HO}(\text{CH}_2)_x\text{CONH}_2\rightarrow\text{Diamond-O}(\text{CH}_2)_x\text{CONH}_2+\text{HCl} \quad (17)$$

$$\text{Diamond-Cl}+\text{HO}(\text{CH}_2)_x\text{COH}\rightarrow\text{Diamond-O}(\text{CH}_2)_x\text{COH}+\text{HCl} \quad (18)$$

(19)

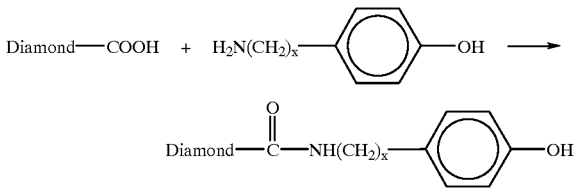

(20)

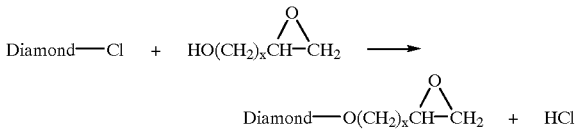

Alternatively, vinyl, alcohol, amide, aldehyde, phenolic, and epoxide groups can be formed on the diamond surface by reacting chlorinated diamond with polyfunctional amines at a temperature between about 0° C. and about 600° C., as indicated in Equations (21) through (26), respectively:

$$\text{Diamond-Cl}+\text{H}_2\text{N}(\text{CH}_2)_x\text{CH}{=}\text{CH}_2\rightarrow\text{Diamond-NH}(\text{CH}_2)_x\text{CH}{=}\text{CH}_2+\text{HCl} \quad (21)$$

$$\text{Diamond-Cl}+\text{H}_2\text{NCH}_2(\text{CH}_2)_x\text{OH}\rightarrow\text{Diamond-NHCH}_2(\text{CH}_2)_x\text{OH}+\text{HCl} \quad (22)$$

$$\text{Diamond-Cl}+\text{H}_2\text{N}(\text{CH}_2)_x\text{CONH}_2\rightarrow\text{Diamond-NH}(\text{CH}_2)_x\text{CONH}_2+\text{HCl} \quad (23)$$

$$\text{Diamond-Cl}+\text{H}_2\text{N}(\text{CH}_2)_x\text{COH}\rightarrow\text{Diamond-NH}(\text{CH}_2)_x\text{COH}+\text{HCl} \quad (24)$$

(25)

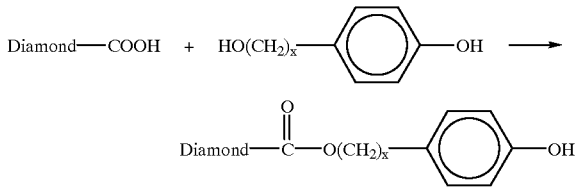

(26)

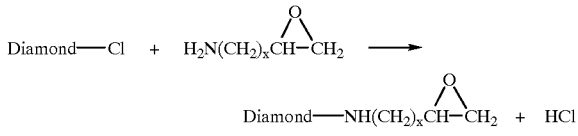

The functionalized diamond surfaces, which are described on the right hand side of Equations (1)–(10) and (13)–(26), can react with precursors that are selected from the group comprising phenolic resins, vinyl resins, polyester resins, epoxy resins, and thermoset resins. The reaction can be attributed to chemistries in the resin precursor. Therefore, when chemical covalent bonds are formed between functional groups and resin by co-polymerization, as embodied by the invention, the diamond will be bound to the resin-bond matrix.

The reactions set forth in Equations (1)–(10), (13)–(26) are suitable for polymerization to chemically bind resin to diamond surfaces to form abrasive composites use analogous chemistries. Combinations of the above-described reactions in Equations (1)–(10), (13)–(26) can be employed in reactions within the scope of the invention.

The functionalized diamonds and the resin-bond matrices that form abrasive composites with the functionalized diamonds, as embodied by the invention, can be used in various applications. The functionalized diamonds and the resin-bond matrices with the functionalized diamonds can be used in the fabrication of resin-bonded abrasive applications, such as, but not limited to, grinding tools. These tools should exhibit enhanced life and performance. An abrasive composite, such as but not limited to a resin bond system, comprises functionalized diamonds, as embodied by the invention, filler materials, such as silicon carbide (SiC) and copper (Cu) powders, and resin materials.

One exemplary process to form the functionalized diamonds, as embodied by the invention, will now be described. The values set forth below are approximate and terms in the description of the invention herein are used with their meaning as understood by a person of ordinary skill in the art. This exemplary process should not be construed as limiting the invention, and is intended for exemplary purposes only.

A starting material comprised a diamond powder with a particle size of 0.75–1.25 $\mu$m. 100 g of this diamond was reacted for 1 h in a boiling mixture of 1000 mL of concentrated $H_2SO_4$ and 100 mL of 70% $HNO_3$ to functionalize the diamond surface with carboxylic acid groups,. When the mixture had cooled, the diamond powder settled out from suspension and the acid was poured off. The diamond was then rinsed by suspending it in 2000 mL of deionized $H_2O$. After 12–24 hours of settling time, the rinse water was poured off. This rinsing procedure was repeated until the pH of the mixture was near 7. A final rinse was then conducted with 1000 mL of acetone. When the diamond had settled, the acetone was poured off and the remaining diamond/acetone slurry was allowed to dry under ambient conditions to yield the carboxylic acid functionalized product.

To functionalize the surface with vinyl groups, 10 g of the carboxylic acid functionalized product from above was placed in a 100 mL round bottom flask. 50 mL of acetone and 10 mL of 5-hexen-1-ol were poured into the flask. A reflux condenser was affixed to the top of the flask and the mixture was heated in a water bath. When the temperature reached 50° C., 5 mL of concentrated hydrochloric acid was added through the reflux condenser. Heating was continued until the mixture began to boil at 75° C. The flask was occasionally swirled to suspend the diamond as necessary. After refluxing for 30 min at 75° C., the mixture was cooled to room temperature and the reaction liquid was poured off of the settled diamond. The diamond product was then washed 5 times by suspending it in 75 mL portions of acetone, allowing time for the diamond to settle, and pouring off the acetone. After the fifth rinse the diamond/acetone slurry was allowed to dry under ambient conditions yielding the vinyl treated product.

Figure 2:
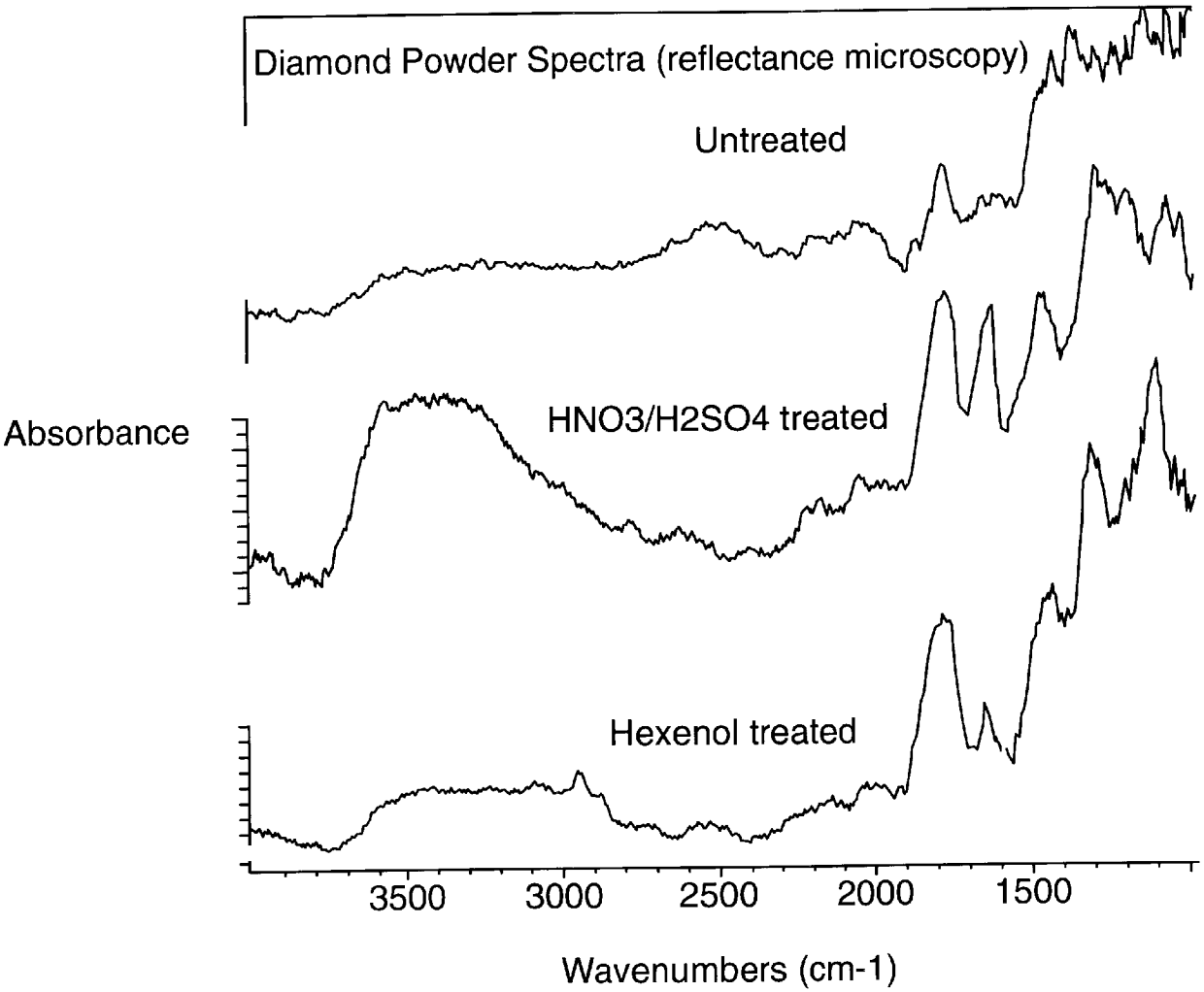
FIG. 2 is a set of infrared spectra on pure (neat) diamond powder taken in an infrared microscope in the reflectance mode to discriminate against water impurities in the KBr matrix.

To verify the functionalization of the diamond, as embodied by the invention, a diffuse reflectance infrared Fourier-transform spectroscopy (DRFTS) test was performed on the samples. For enhanced sensitivity, the functionalized diamonds were mixed with potassium bromide (KBr) powder as in known in the art. The spectral results are illustrated in FIG. 1. Further spectra of pure (neat) diamond powder samples were taken in an infrared microscope in the reflectance mode to discriminate against water impurities in the KBr matrix. These further spectra are illustrated in FIG. 2.

The test indicated that in untreated diamond powder, a large spectral peak occurs at 1760 $cm^{-1}$ and may be assigned to a stretching mode of surface >C═O groups, as known in the art. Additional spectral peaks occur at frequencies in a range from about 1500 $cm^{-1}$ and about 1000 $cm^{-1}$ in untreated powder and these may be assigned to a combination of C—O modes associated with C—O—C ether groups and C—OH hydroxyl groups, also as known. A broad spectrum peak in a range from about 3000 $cm^{-1}$ to about 3700 $cm^{-1}$ (FIG. 1) is believed to be mainly due to physisorbed water in the KBr matrix. This peak was diminished in reflectance spectra of the neat diamond powder (FIG. 2). Finally, the spectrum peaks that are in a range from about 1900 $cm^{-1}$ to about 2400 $cm^{-1}$ are due to bulk absorption in diamond powder rather than to surface species.

The spectrum of the powder after treatment in $HNO_3$/$H_2SO_4$ is qualitatively similar to that discussed above, however, it illustrates differences that indicate an increase in the concentration of surface —COOH groups. The >C═O stretching mode intensity has increased has shifted to about 1788 $cm^{-1}$, which is consistent with an increase in the degree of surface oxidation. A broad peak in a range from about 3000 $cm^{-1}$ to about 3700 $cm^{-1}$ is larger (FIG. 1) and also prominent in reflectance spectra of the neat diamond powder (FIG. 2), and is indicative of surface COO—H stretch modes. The concentration of surface —COOH groups is believed to be about one monolayer, or in a range from about $1.5–2.0\times10^{15}$ $cm^{-2}$.

After treatment of the acid-treated diamond with 5-hexen-1-ol under acid-catalyzed esterification conditions, a low-frequency spectrum portion is largely unchanged, however, but new peaks due to C—H stretch modes may occur in a range from about 2800 $cm^{-1}$ to about 3100 $cm^{-1}$. These peaks between are believed to be due to $sp^3$-hybridized $CH_2$ groups in chemisorbed —$(CH_2)_4CH{=}CH_2$ species, while the peak at 3080 $cm^{-1}$ is due to the $sp^2$-hybridized $CH{=}CH_2$ groups in the same species. The intensities of vinyl CH and aliphatic $CH_2$ peaks is about 0.045, in general agreement with a corresponding ratio (0.17) observed in —$CH_2$—CH═CH—$CH_2$— chemisorbed on diamond (100) after correction for the relative numbers of hydrogen atoms. The orientation of the C═C bonds is different in the two cases, and a mode of spectroscopy is different (diffuse reflectance versus total internal reflection). Thus, precise agreement in the infrared intensity ratio is not expected. No new C—OH mode appears in the spectrum, which indicates that CH modes are due to chemisorbed species rather than residual 5-hexen-1-ol impurity in the diamond powder.

Further, a COO—H peak is greatly reduced in intensity, as illustrated in the reflectance spectrum (FIG. 2). Taken together, these spectral observations (FIG. 1 and FIG. 2) indicate that —COOH groups on a diamond surface after the acid treatment have reacted with the 5-hexen-1-ol to form —$COO(CH_2)_4CH{=}CH_2$, as embodied by the invention. The reduction by a factor in a range from about 2 to about 3 in the COO—H intensity suggests formation of about ½ to ⅔ of a monolayer of surface vinyl groups, and alternatively a surface concentration in a range from about 0.8 to about $1.3\times10^{15}$ While various embodiments are described herein, it will be appreciated from the specification that various combinations of elements, variations or improvements therein may be made by those skilled in the art, and are within the scope of the invention.

We claim:

1. An abrasive composite comprising at least one functionalized diamond in a resin-bond matrix, the functionalized diamond comprising an organic moiety, the organic moiety being selected from at least one of:

vinyl, amide, alcohol, phenolic, aldehyde, and epoxide groups, and combinations thereof.

2. An abrasive composite comprising at least one functionalized diamond in a resin-bond matrix, the diamond being functionalized by an organic moiety by the following reaction, where x is an integer between 0 and about 20:

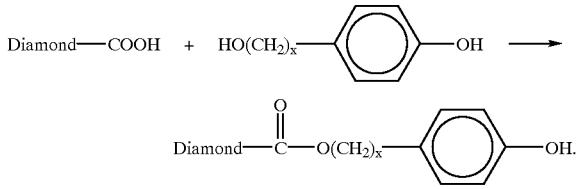

3. An abrasive composite comprising at least one functionalized diamond in a resin-bond matrix, the diamond being functionalized by an organic moiety by any one of the following reactions, where x is an integer between 0 and about 20, Diamond-COOH+$HO(CH_2)_xCH{=}CH_2$→Diamond-$COO(CH_2)_xCH{=}CH_2$;

Diamond-COOH+$HOCH_2(CH_2)_xOH$→Diamond-$COOCH_2(CH_2)_xOH$;

Diamond-COOH+$HO(CH_2)_xCONH_2$→Diamond-$COO(CH_2)_xCONH_2$;

Diamond-COOH+$HO(CH_2)_xCOH$→Diamond-$COO(CH_2)_xCOH$;

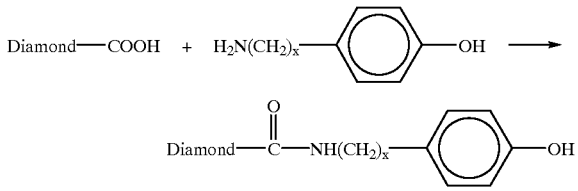

Diamond-COOH+$H_2N(CH_2)_xCH{=}CH_2$→Diamond-$CONH(CH_2)_xCH{=}CH_2$;

Diamond-COOH+$H_2NCH_2(CH_2)_xOH$→Diamond-$CONHCH_2(CH_2)_xOH$;

Diamond-COOH+$H_2N(CH_2)_xCONH_2$→Diamond-CONH$(CH_2)_xCONH_2$; and

Diamond-COOH+$H_2N(CH_2)_xCOH$→Diamond-CONH$(CH_2)_xCOH$;

Diamond-Cl+$C_3H_6$→Diamond-$CH_2CH{=}CH_2$+HCl; and

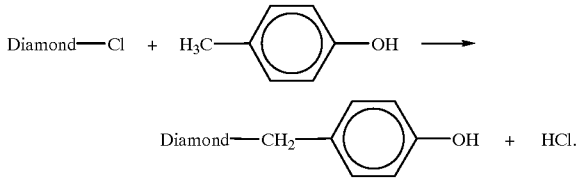

4. An abrasive composite comprising at least one functionalized diamond in a resin-bond matrix, the diamond being functionalized by an organic moiety by any one of the following reactions, where x is an integer between 0 and about 20:

Diamond-Cl+$HO(CH_2)_xCH{=}CH_2$→Diamond-$O(CH_2)_xCH{=}CH_2$+HCl;

Diamond-Cl+$HOCH_2(CH_2)_xOH$→Diamond-$OCH_2(CH_2)_xOH$+HCl;

Diamond-Cl+$HO(CH_2)_xCONH_2$→Diamond-$O(CH_2)_xCONH_2$+HCl;

Diamond-Cl+$HO(CH_2)_xCOH$→Diamond-$O(CH_2)_xCOH$+HCl;

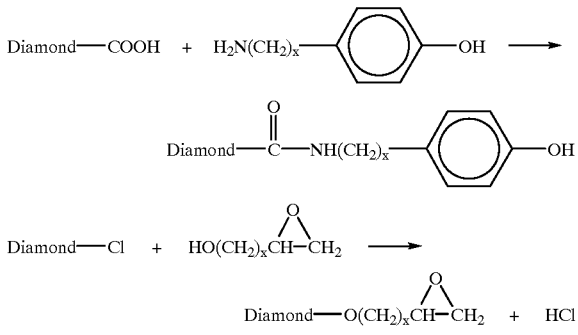

Diamond-Cl+$H_2N(CH_2)_xCH{=}CH_2$→Diamond-$NH(CH_2)_xCH{=}CH_2$+HCl;

Diamond-Cl+$H_2NCH_2(CH_2)_xOH$→Diamond-$NHCH_2(CH_2)_xOH$+HCl;

Diamond-Cl+$H_2N(CH_2)_xCONH_2$→Diamond-$NH(CH_2)_xCONH_2$+HCl;

Diamond-Cl+$H_2N(CH_2)_xCOH$→Diamond-$NH(CH_2)_xCOH$+HCl;

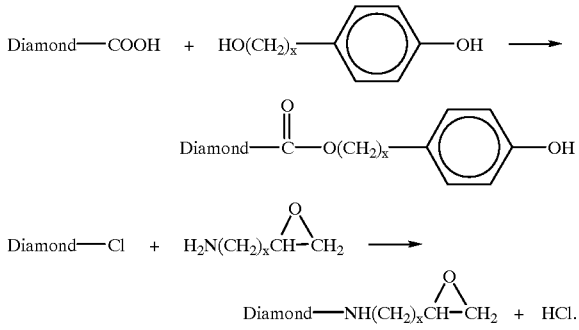

5. A tool for abrasive applications, the tool comprising at least one functionalized diamond in a resin-bond matrix, the functionalized diamond comprising an organic moiety, the organic moiety being selected from at least one of:

vinyl, amide, alcohol, phenolic, aldehyde, and epoxide groups, and combinations thereof.

6. A tool for abrasive applications, the tool comprising at least one functionalized diamond in a resin-bond matrix, the diamond being functionalized by an organic moiety by the following reaction, where x is an integer between 0 and about 20:

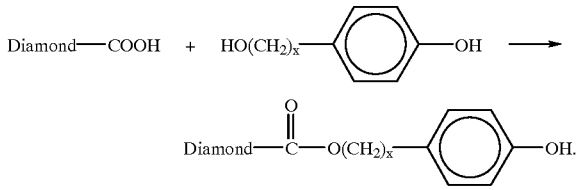

7. A tool for abrasive applications, the tool comprising at least one functionalized diamond in a resin-bond matrix, the diamond being functionalized by an organic moiety by any one of the following reactions, where x is an integer between 0 and about 20:

Diamond-COOH+$HO(CH_2)_xCH{=}CH_2$→Diamond-$COO(CH_2)_xCH{=}CH_2$;

Diamond-COOH+$HOCH_2(CH_2)_xOH$→Diamond-$COOCH_2(CH_2)_xOH$;

Diamond-COOH+$HO(CH_2)_xCONH_2$→Diamond-$COO(CH_2)_xCONH_2$;

Diamond-COOH+$HO(CH_2)_xCOH$→Diamond-$COO(CH_2)_xCOH$;

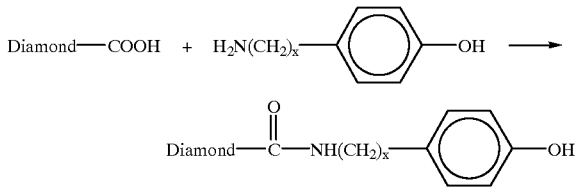

Diamond-COOH+$H_2N(CH_2)_xCH{=}CH_2$→Diamond-$CONH(CH_2)_xCH{=}CH_2$;

Diamond-COOH+$H_2NCH_2(CH_2)_xOH$→Diamond-$CONHCH_2(CH_2)_xOH$;

Diamond-COOH+$H_2N(CH_2)_xCONH_2$→Diamond-CONH$(CH_2)_xCONH_2$; and

Diamond-COOH+$H_2N(CH_2)_xCOH$→Diamond-CONH$(CH_2)_xCOH$;

Diamond-Cl+$C_3H_6$→Diamond-$CH_2CH{=}CH_2$+HCl; and

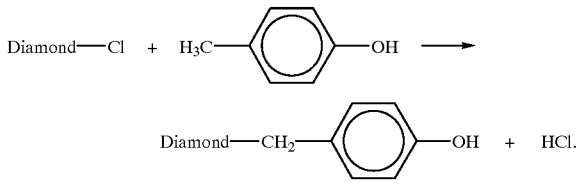

8. A tool for abrasive applications, the tool comprising at least one functionalized diamond in a resin-bond matrix, the diamond being functionalized by an organic moiety by any one of the following reactions, where x is an integer between 0 and about 20:

Diamond-Cl+$HO(CH_2)_xCH{=}CH_2$→Diamond-$O(CH_2)_xCH{=}CH$+HCl;

Diamond-Cl+$HOCH_2(CH_2)_xOH$→Diamond-$OCH_2(CH_2)_xOH$+HCl;

Diamond-Cl+$HO(CH_2)_xCONH_2$→Diamond-$O(CH_2)_xCONH_2$+HCl;

Diamond-Cl+$HO(CH_2)_xCOH$→Diamond-$O(CH_2)_xCOH$+HCl;

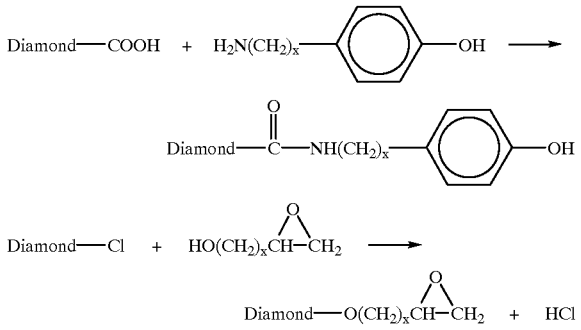

Diamond-Cl+$H_2N(CH_2)_xCH{=}CH_2$→Diamond-$NH(CH_2)_xCH{=}CH_2$+HCl;

Diamond-Cl+$H_2NCH_2(CH_2)_xOH$→Diamond-$NHCH_2(CH_2)_xOH$+HCl;

Diamond-Cl+$H_2N(CH_2)_xCONH_2$→Diamond-$NH(CH_2)_xCONH_2$+HCl;

Diamond-Cl+$H_2N(CH_2)_xCOH$→Diamond-$NH(CH_2)_xCOH$+HCl;

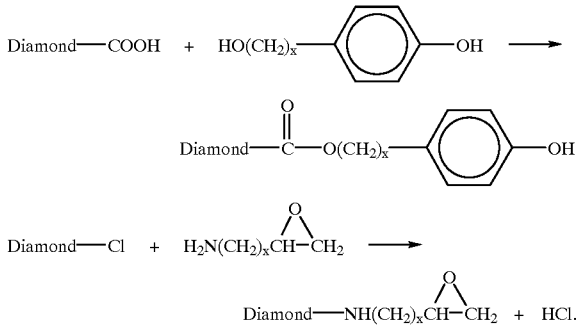

9. An abrasive composite comprising:

at least one functionalized diamond, the functionalized diamond comprising an organic functionalized moiety, the organic functionalized moiety being selected from: vinyl, amide, alcohol, acidics, phenolics, hydroxyls, carboxyl, aldehyde, and aliphatics, and combinations thereof;

a resin-bond matrix; and a filler material selected from at least one of silicon carbide (SiC) and copper(Cu).

10. An abrasive composite comprising at least one diamond, the at least one diamond comprising an organic moiety, the organic moiety being selected from at least one of:

vinyl, amide, alcohol, phenolic, aldehyde, and epoxide groups, and combinations thereof.

11. An abrasive tool comprising at least one diamond, the at least one diamond comprising an organic moiety, the organic moiety being selected from at least one of:

vinyl, amide, alcohol, phenolic, aldehyde, and epoxide groups, and combinations thereof.

* * * * *